US007287483B2

(12) United States Patent
Thompson

(10) Patent No.: US 7,287,483 B2
(45) Date of Patent: Oct. 30, 2007

(54) BOAT FENDER AND METHOD OF PROTECTING FLOATING OBJECTS

(76) Inventor: Alan Thompson, P.O. Box 354, Camas, WA (US) 98607

( * ) Notice: Subject to any disclaimer, the term of this patent is extended or adjusted under 35 U.S.C. 154(b) by 0 days.

(21) Appl. No.: 11/319,246

(22) Filed: Dec. 27, 2005

(65) Prior Publication Data

US 2006/0137589 A1 Jun. 29, 2006

Related U.S. Application Data

(60) Provisional application No. 60/639,835, filed on Dec. 27, 2004.

(51) Int. Cl.
*B63B 59/02* (2006.01)

(52) U.S. Cl. ..... 114/219; 405/212

(58) Field of Classification Search ..... 114/219; 244/100 R; 405/212, 215
See application file for complete search history.

(56) References Cited

U.S. PATENT DOCUMENTS

| | | | | |
|---|---|---|---|---|
| 1,361,902 | A | 12/1920 | Porteous | |
| 1,800,167 | A * | 4/1931 | Bernard | 244/100 R |
| 2,179,125 | A | 11/1939 | Kirlin | |
| 2,197,839 | A | 4/1940 | Roberts et al. | |
| 2,737,142 | A | 3/1956 | Andri | |
| 2,960,055 | A * | 11/1960 | Tomek | 114/219 |
| 3,063,400 | A | 11/1962 | Yamaguchi et al. | |
| 3,145,686 | A * | 8/1964 | Blythe | 114/219 |
| 3,276,414 | A * | 10/1966 | Lee | 114/219 |
| 3,498,252 | A | 3/1970 | Peacock | |
| 3,584,464 | A * | 6/1971 | Saadeh et al. | 405/215 |
| 3,593,531 | A | 7/1971 | Saadeh et al. | |
| 3,988,997 | A * | 11/1976 | Fenton | 114/219 |
| 4,228,758 | A | 10/1980 | Dornau et al. | |
| 4,252,073 | A | 2/1981 | Hartung et al. | |
| 4,697,956 | A | 10/1987 | Plaisance | |
| 4,877,224 | A | 10/1989 | Watts | |
| 4,924,796 | A * | 5/1990 | Duffy | 114/219 |
| 5,299,522 | A | 4/1994 | Dixon, Jr. | |
| 5,671,692 | A * | 9/1997 | Kimball | 114/219 |
| 5,715,769 | A | 2/1998 | Mills | |
| 5,766,711 | A | 6/1998 | Barmakian | |
| 5,947,048 | A | 9/1999 | McEntire | |
| 6,406,221 | B1 | 6/2002 | Collier | |
| 6,983,711 | B1 * | 1/2006 | Lemke | 114/219 |

FOREIGN PATENT DOCUMENTS

| | | | |
|---|---|---|---|
| EP | 000060177 | A1 | 9/1982 |
| JP | 02001151193 | A | 6/2001 |
| JP | 02002021044 | A | 1/2002 |

* cited by examiner

*Primary Examiner*—Lars A. Olson

(57) ABSTRACT

A fender includes an inflatable body that is partially filled with water, a port sized to receive the water into the body and a plug adapted to seal the port. The partially filed fender floats in the water with a lower portion extending and remaining below the water even during wave action, leaving the bottom portion of the fender to protect a portion of a floating object that extends below the waterline.

18 Claims, 5 Drawing Sheets

BOAT FENDER AND METHOD OF PROTECTING FLOATING OBJECTS

CROSS-REFERENCES TO RELATED APPLICATIONS

This application claims the benefit from U.S. Provisional Patent Application No. 60/639,835 filed on Dec. 27, 2004, whose contents are incorporated herein for all purposes.

BACKGROUND OF THE INVENTION

1. Field of the Invention

The invention is directed toward boat fenders and more particularly to ballasted boat fenders.

2. Description of the Prior Art

The need for ballasted boat fenders relates to water conditions induced by wind, tide or, in many areas, by boat traffic. As wave conditions increase, a vessel will begin to heave. If the vessel is tied to a dock, an inflatable fender eventually ends up on the dock. With the inflatable fender on the dock, the vessel is left unprotected.

Many newly constructed marinas use concrete docks, which are very stable relative to most light vessels. In active wave conditions, the lighter vessel moves up and down, but the dock remains relatively stationary. Again, with an inflatable fender, the fender is easily jostled onto the dock leaving the vessel to scrape against the concrete dock.

The drawbacks of conventional inflatable fenders is illustrated in FIGS. 1 and 6 showing typical boat and seaplane fenders, respectively. As shown in FIG. 1, the inflatable fender 20 floats on the surface of the water where wave action rocks the boat 22 up and down, thus acting to easily dislodge the inflatable fender 20. In FIG. 6, a conventional seaplane float 56 is typically made from aluminum and has a chine area 60 that extends laterally below the waterline 28. Because inflatable fender 20 is tied to dock 58 and floats on top of the water, the chine 60 is left unprotected and is allowed to bang against any portion of the dock 58 extending below the waterline 28.

Accordingly, the need remains for a fender that is adapted to extend below the surface of the water to protect a floating craft against impacts against a dock or other objects, and particularly one that is easily ballasted with water for use as a fender and easily emptied of the water for lightweight storage.

SUMMARY OF THE DISCLOSURE

A watercraft fender includes an inflatable body that is partially filled with water, a port sized to allow entry of water into the inflatable body and a plug adapted to seal the port.

A method of protecting a water borne vessel includes affixing a fender to the vessel, filling the fender partially with water and sealing the fender. The fender is then floated in the water next to the vessel such that a lower portion of the fender extends and remains below a waterline of the vessel.

DETAILED DESCRIPTION

Figure 2:
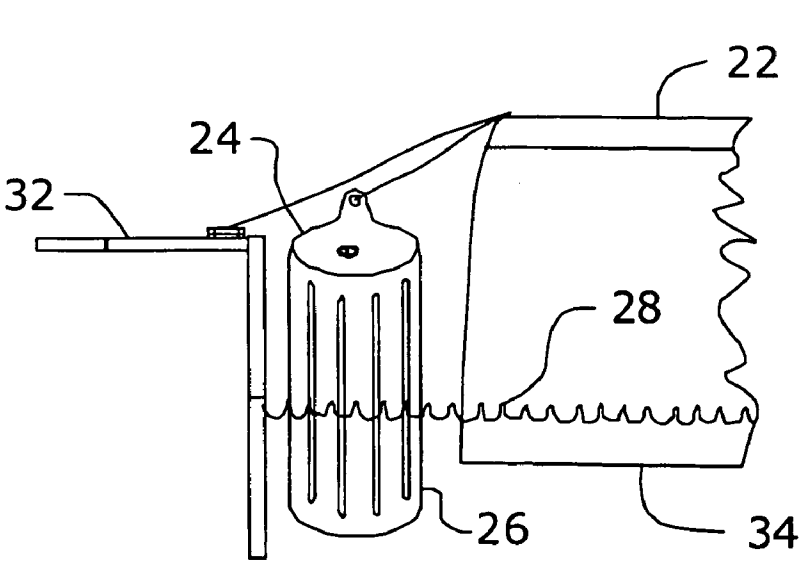
FIG. 2 is a simplified elevation view of a boat tied to a dock using a ballasted fender between the boat and the dock.
Figure 1:
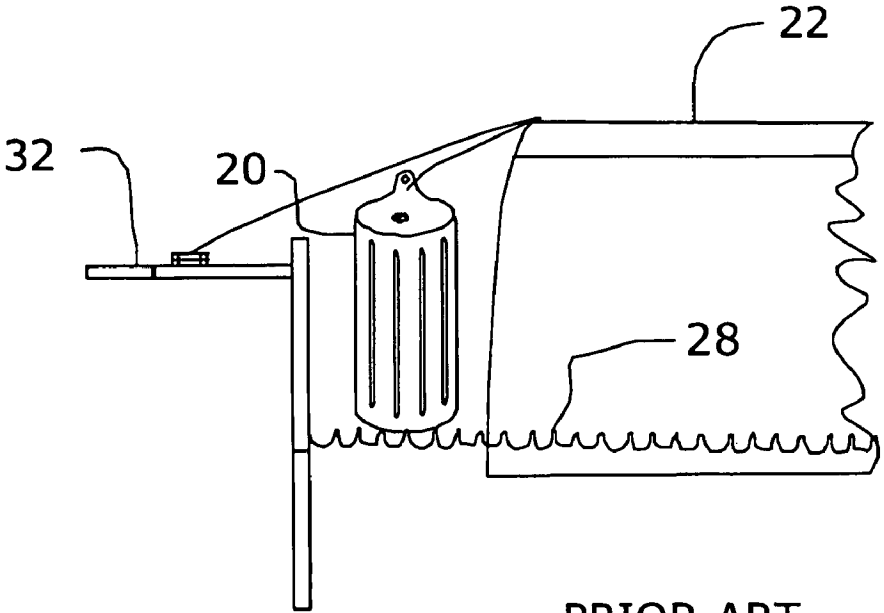
PRIOR ART Fig 1
FIG. 1 is a simplified elevation view of a boat tied to a dock using a conventional inflatable fender between the boat and the dock.

FIG. 2 shows a simplified elevation view of boat 22 using a barrel-shaped ballasted fender 24. The ballasted fender 24 is partially filled with water allowing a lower portion 26 to extend below the waterline 28. Even if the height of wave action reaches the height 30 of the dock 32, the lower portion 26 of the ballasted fender 24 will remain below the water line 28, and thus not end up on the dock 32. The fender 24 floats at a preferable height when the fender 24 is approximately half-filled with water.

Another advantage of the ballasted fender 24 as shown in FIG. 2 is that by having the lower portion 26 extend below the waterline 28, the fender 24 protects a lower portion 34 of the boat 22.

Figure 7:
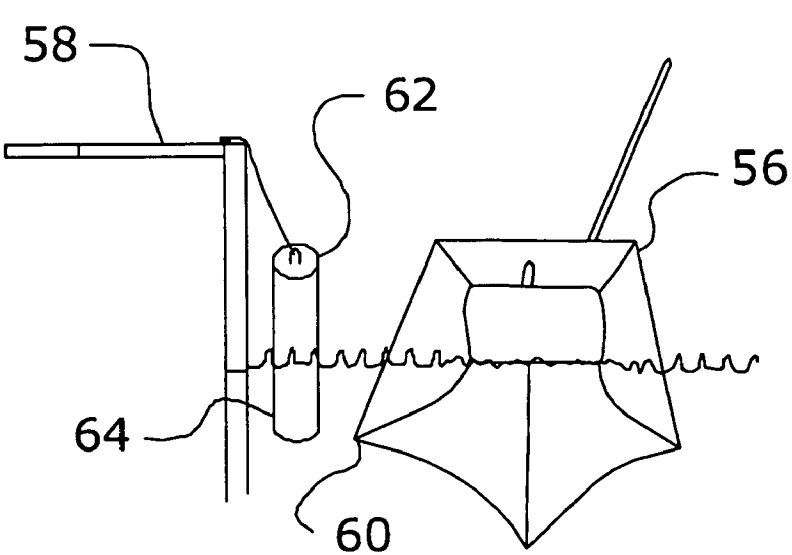
FIG. 7 is a simplified elevation view of a seaplane float using a barrel-shaped ballasted fender.

While the fender 24 is described as being used with a boat, it is contemplated that the fender 24 is useful for any floating objects that need protection below the water line of the object including but not limited to rafts, docks, barges and seaplanes (as shown in FIG. 7). The word vessel or boat as used throughout the specification and claims is meant to include these floating objects.

Figure 3:
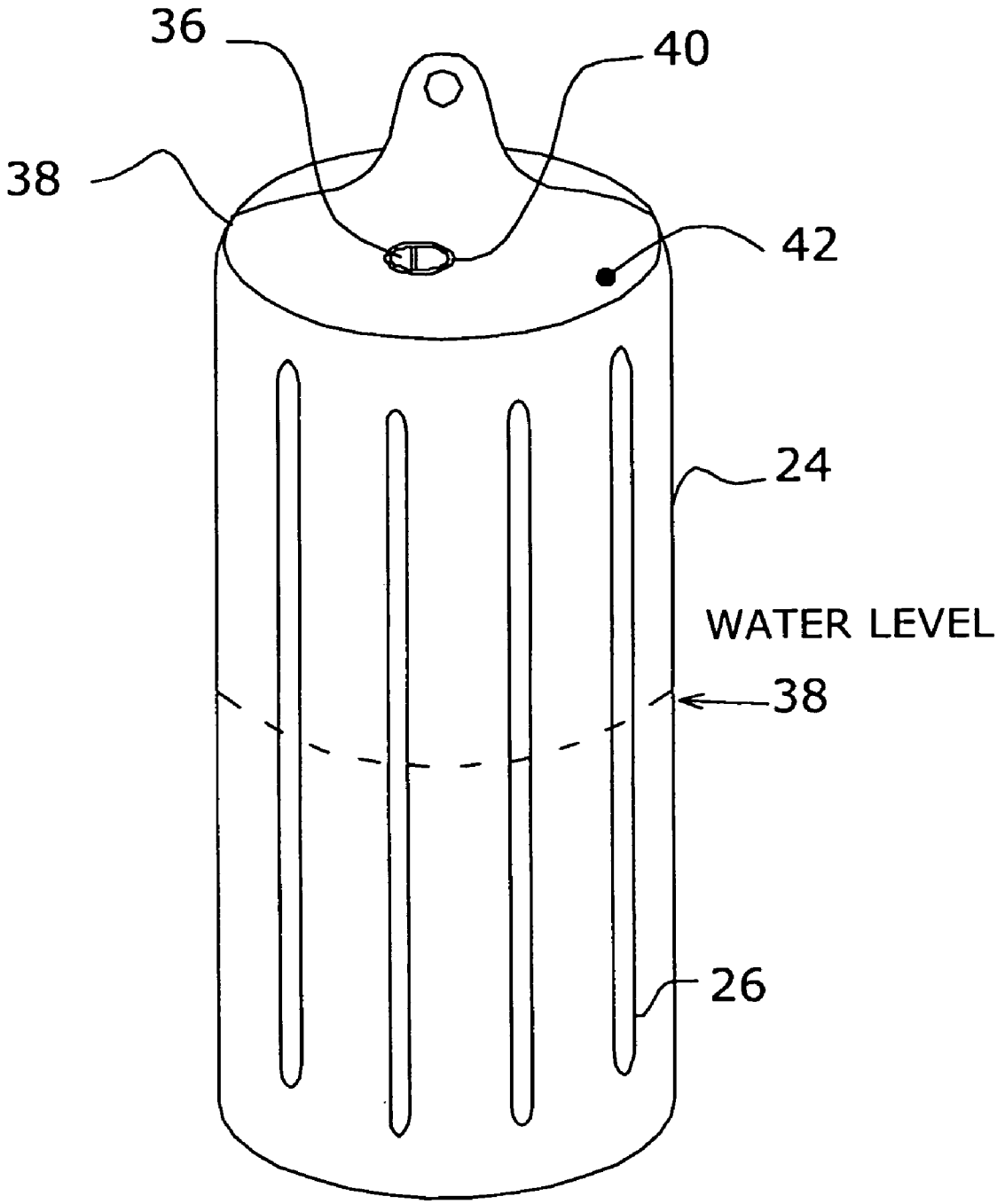
FIG. 3 is a side elevation view of a barrel-shaped ballasted fender showing a typical waterline.

FIG. 3 is a side elevation view of the barrel-shaped ballasted fender 24 shown floating in the water partially submerged with the lower portion 26 extending below the waterline 28. Threaded plug 36 is positioned in port 40 in shoulder 38 of the fender 24. The threaded plug 36 can easily be removed from the port 40 for filling the fender with water. The fender 24 can be filled either by pouring water into port 40 or by simply submerging the fender 24 with the plug 36 removed. For larger fenders, port 40 can be sized to receive a standard garden hose (not shown).

Air valve 42 located on shoulder 38 can provide two different functions. The air valve 42 can be adapted to receive an air pump (not shown) such as those used to pump basketballs and footballs. Normally, filling the fender 24 approximately halfway with water and leaving the remaining volume filled with air at normal atmospheric pressure provides enough buoyancy. Air valve 42 would allow a user to further adjust the flotation height 44 of the fender 24, if desired, by pumping in or releasing air from the fender 24. Upon emptying water from the fender 24, the fender 24 is much lighter making it easier to store.

Figure 4:
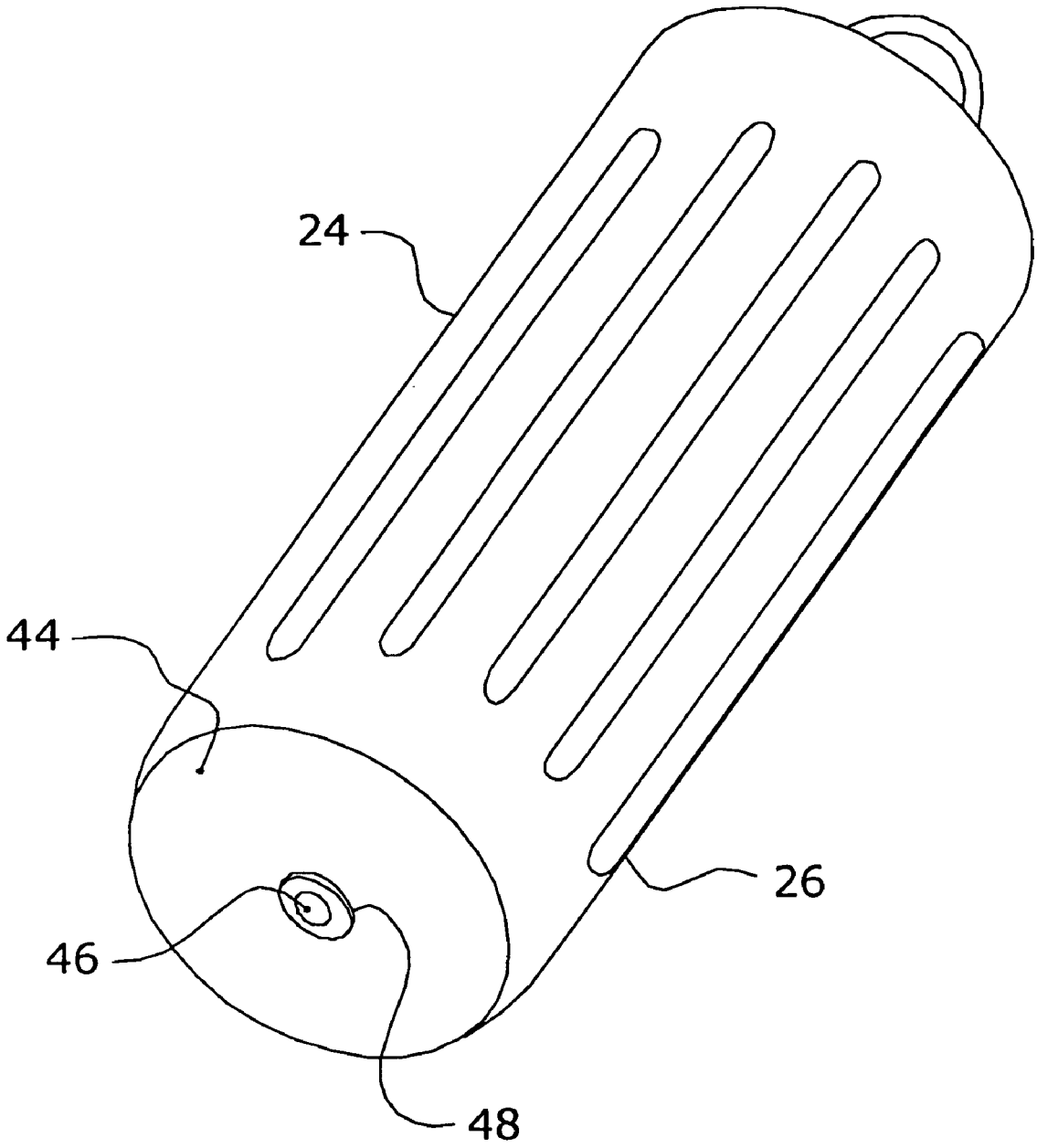
FIG. 4 is perspective view of the barrel-shaped ballasted fender showing a bottom of the fender.

FIG. 4 is a perspective view of another embodiment of the barrel-shaped ballasted fender 24 showing the bottom 44 of the fender 24. Plug 46 is located in hole 48 on the bottom 44 of the fender 24 for filling up and emptying the fender. Similar to plug 36, plug 46 can be threaded into hole 48. Hole 48 can also be cut into the bottom 44 of fender 24 with plug 46 temporarily attached in hole 48 with glue such as shoe goo.

Air valve 42 (shown in FIG. 3) can also be used with the embodiment shown in FIG. 4.

Figure 5:
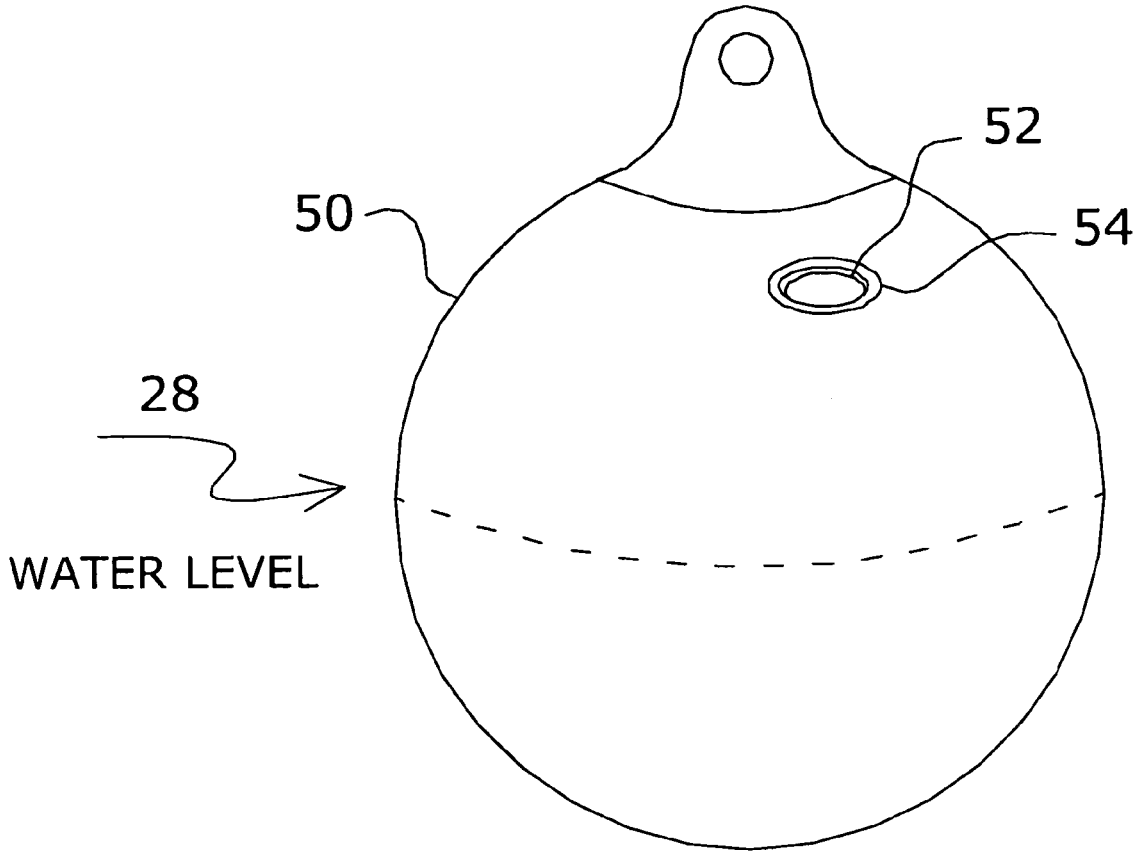
FIG. 5 is a side elevation view of a spherically shaped ballasted fender.

FIG. 5 is a side elevation view of a spherically shaped ballasted fender 50. The fender 50 includes plug 52 in port 54. Port 54 is used for filling and emptying the fender 50. Air valve 42 (shown in FIG. 3) can also be similarly used on fender 50.

Figure 6:
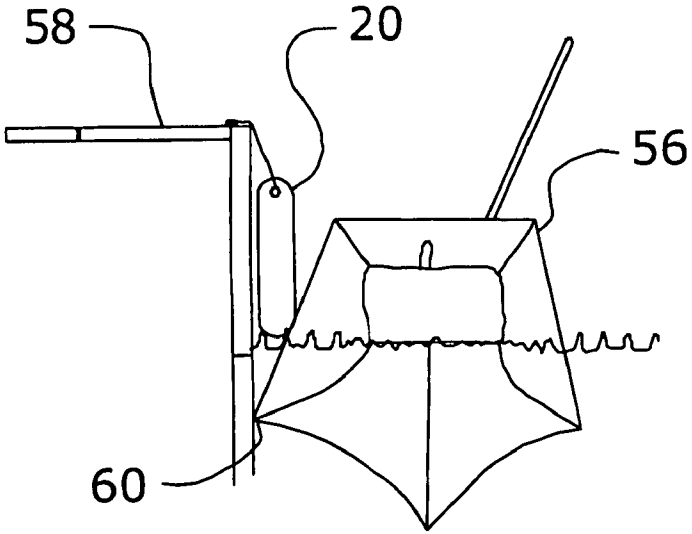
PRIOR ART Fig 6
FIG. 6 is a simplified elevation view of a seaplane float using a conventional inflatable fender between the float and the dock.

FIG. 7 is a simplified elevation view of the seaplane float 56 tied to dock 58 using a long ballasted fender 62 constructed according to concepts of this invention, and intended to address the drawbacks of the prior art device shown in FIG. 6. Long ballasted fender 62 is sized to be long enough to have lower portion 64 extend below the waterline 28 to protect chine 60 from the dock 58. The chine 60 of seaplane float 56 typically is located farther below the waterline 28 than areas in need of protection on typical boats. Thus the longer ballasted fender 62 would be used instead of the more standard-sized ballasted fenders 24 and 50.

While the barrel-shape of fenders 22 and 62 and the spherical shape of fender 50 have been described and depicted, fenders of other shapes are also considered to be within the scope of the invention.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

The invention claimed is:

1. A watercraft fender comprising: an inflatable body that is partially filled with water; a port that is sized to allow the entry of water into the inflatable body; an air valve that is adapted to receive an air pump, the air valve being located on a shoulder of the inflatable body; and a plug that is adapted to seal the port.

2. The fender of claim 1, wherein the port is located on a shoulder of the inflatable body.

3. The fender of claim 1, wherein the port is threaded and the plug is correspondingly threaded to be received into the port.

4. The fender of claim 1, wherein the inflatable body is barrel-shaped.

5. The fender of claim 1, wherein the inflatable body is spherically shaped.

6. The fender of claim 1, wherein the port is a hole on a bottom of the inflatable body.

7. The fender of claim 6, wherein the plug is temporarily affixed to the hole with an adhesive.

8. A method of protecting a waterborne vessel comprising: affixing a fender to the vessel; affixing a garden hose to a port on the fender; filling the fender partially with water; sealing the fender; and floating the fender in the water adjacent to the vessel such that a lower portion of the fender extends and remains below a waterline of the vessel.

9. The method of claim 8, wherein filling the fender partially with water includes pouring water into a port in the fender, and sealing the fender includes affixing a plug to the port.

10. The method of claim 9, wherein affixing a plug to the port includes threading the plug into the port.

11. The method of claim 9, wherein affixing a plug to the port includes temporarily affixing the plug to the port with an adhesive.

12. The method of claim 8, wherein filling the fender partially with water includes submerging the fender and allowing water to enter the fender through a port.

13. The method of claim 8, wherein filling the fender partially with water includes filling the interior about halfway with water.

14. The method of claim 8, further comprising adjusting a height of flotation of the fender by pumping air into the fender through an air valve.

15. The method of claim 14, wherein adjusting a height of flotation of the fender includes releasing air from the fender through the air valve.

16. A watercraft fender comprising: a body that defines a hollow chamber; a first port that is adapted to admit water therethrough into the hollow chamber; a second port that is adapted to admit air therethrough into the hollow chamber; a plug that is adapted to seal the first port; and a second plug that is adapted to seal the second port; where the hollow chamber is only partially filled with ballast and the remainder with air so that at least a substantial portion of the body is submerged below a waterline.

17. The watercraft fender of claim 16, wherein the port is defined on an upper shoulder of the body above the waterline.

18. The watercraft fender of claim 16, wherein the port is defined on a bottom of the body below the waterline.

* * * * *